US007347076B1

(12) United States Patent
Cha

(10) Patent No.: US 7,347,076 B1
(45) Date of Patent: Mar. 25, 2008

(54) FORGING METHOD AND APPARATUS FOR FORMING HELICAL GEAR

(75) Inventor: Jae-Do Cha, Jinju-si (KR)

(73) Assignee: Korea Motor Co., Ltd., Gyungsangnam-do (KR)

( * ) Notice: Subject to any disclaimer, the term of this patent is extended or adjusted under 35 U.S.C. 154(b) by 0 days.

(21) Appl. No.: 11/748,606

(22) Filed: May 15, 2007

(51) Int. Cl.
*B21K 1/30* (2006.01)

(52) U.S. Cl. ..... 72/344; 72/467; 72/372; 72/355.2; 29/893.34

(58) Field of Classification Search ..... 72/343, 72/344, 252, 353.2, 355.2, 372, 467, 253.1; 29/893.34
See application file for complete search history.

(56) References Cited

U.S. PATENT DOCUMENTS

| | | | | |
|---|---|---|---|---|
| 3,186,210 | A * | 6/1965 | Lesher et al. | 72/467 |
| 4,622,842 | A * | 11/1986 | Bachrach et al. | 72/467 |
| 5,052,210 | A * | 10/1991 | Hoge | 72/467 |
| 5,275,046 | A * | 1/1994 | Nagpal et al. | 72/467 |
| 5,295,382 | A * | 3/1994 | Fuhrman | 72/343 |
| 5,996,229 | A * | 12/1999 | Yang | 29/893.34 |
| 6,178,801 | B1 * | 1/2001 | Ishida | 72/354.2 |
| 6,470,728 | B2 * | 10/2002 | Sekiguchi | 72/344 |
| 2005/0061101 | A1 * | 3/2005 | Grobel | 74/457 |

FOREIGN PATENT DOCUMENTS

JP 03230842 A * 10/1991

* cited by examiner

*Primary Examiner*—Dmitry Suhol
(74) *Attorney, Agent, or Firm*—Lowe Hauptman Ham & Berner LLP

(57) ABSTRACT

Disclosed herein are a helical gear forging apparatus wherein a forming introduction portion thereof, used to form gear teeth of the helical gear, is variable in shape on the basis of the desired helix angle of the gear-teeth so as to constantly keep a predetermined outer diameter of the formed gear teeth, thereby enabling easy forming of the helical gear irrespective of a variation of the helix angle, and a forging method using the same. The forging apparatus comprises a gear die having a gear teeth forming section defined at an inner circumference thereof for forming gear teeth of the helical gear, a collar die integrally formed at an upper end of the gear die, a lower die located below the gear die, a punch located above the collar die and adapted to push a stock into the collar die, and a knock-out located below the lower die and adapted to discharge the molded stock to the outside.

4 Claims, 6 Drawing Sheets

FORGING METHOD AND APPARATUS FOR FORMING HELICAL GEAR

BACKGROUND OF THE INVENTION

1. Field of the Invention

The present invention relates to a forging method and apparatus for forming helical gears, and more particularly to an improved cold forging method and apparatus for forming gears, such as helical gears, by pressing a stock into a helical mold.

2. Description of the Related Art

Conventionally, a helical gear, formed through cold forging, is directly usable without post-treatment of a gear portion thereof, leading to considerable economic benefit.

In the case of forming the helical gear by cold forging, however, it is difficult to form various helical gears having different helix angles with high accuracy since heretofore there has been given no consideration to the helical angle. Of course, although some products show high accuracy, it is insufficient to effectively deal with a requirement of producing helical gears increasingly being diversified.

Considering the conventional configuration of a forging apparatus for forming a helical gear, it comprises: a gear die having a gear teeth forming section defined at the inner circumference thereof for forming helical gear teeth; and a collar die integrally formed at an upper end of the gear die.

The conventional forging apparatus further comprises: a lower die located below the gear die; a punch located above the collar die for pushing a stock into the collar and gear dies; and a knock-out located below the lower die for discharging the molded stock to the outside.

When using the above described helical gear forging apparatus, due to a relative circumferential rotational force produced between the punch and the gear die and the integral structure of the gear die and the collar die, it is impossible that the stock rotates in a circumferential direction of the gear die relative to the gear die when it is pushed into the gear die.

For this reason, when gear teeth are formed on the outer circumference of the metal stock, the stock is inevitably displaced in an axial direction, disadvantageously causing lead gaps between the respective gear teeth formed in the gear die.

Such lead gaps exert an excessive stress on either side of the angled tooth of the stock inside the gear die, resulting in a pressure difference on toothed portions of the gear die and elastic restoration force on either side of the tooth of the resulting product.

This becomes a factor of adhesion and wear on the toothed portions of the die, and even damages the toothed portions.

SUMMARY OF THE INVENTION

Therefore, the present invention has been made in view of the above problems, and it is an object of the present invention to provide a helical gear forging apparatus wherein a forming introduction portion thereof, used to form gear teeth of the helical gear, is variable in shape on the basis of the desired helix angle of the gear-teeth so as to constantly keep a predetermined outer diameter of the formed gear teeth, thereby enabling easy forming of the helical gear irrespective of a variation of the helix angle, and a forging method using the same.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be explained with reference to the accompanying drawings.

Figure 1:
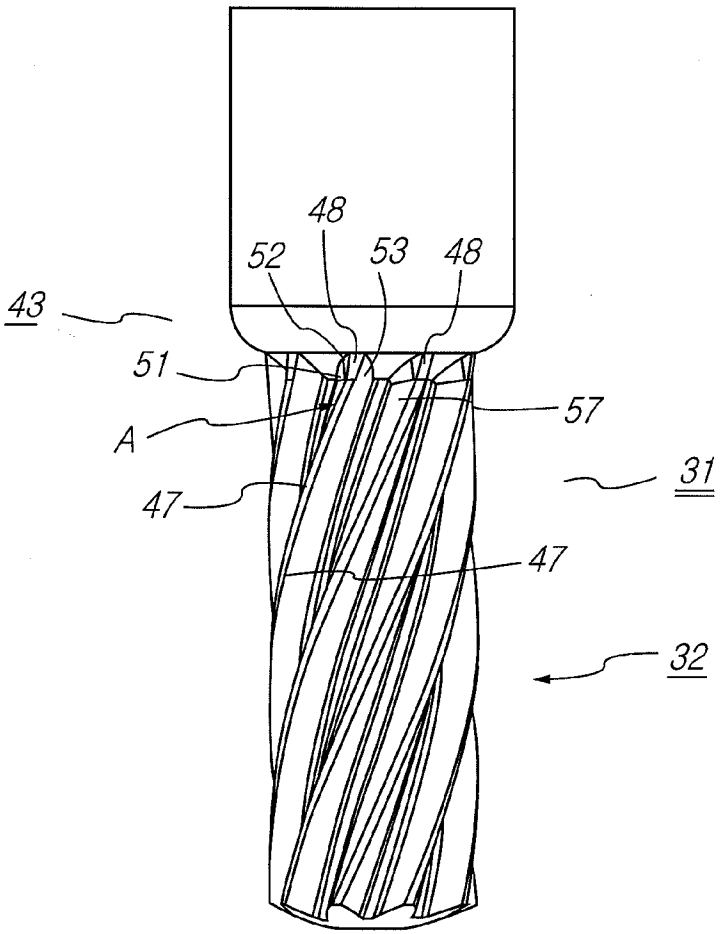
FIG. 1 is a front view illustrating a helical gear in accordance with the present invention.
Figure 2:
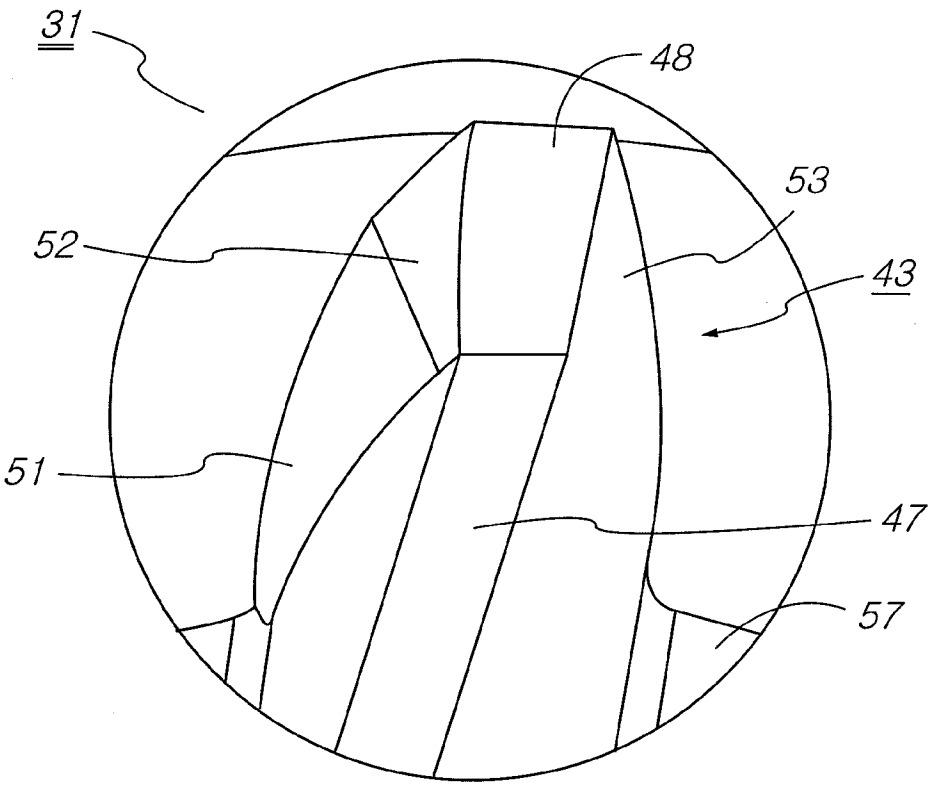
FIG. 2 is an enlarged view illustrating the part of the helical gear denoted by the arrow A shown in FIG. 1.
Figure 3:
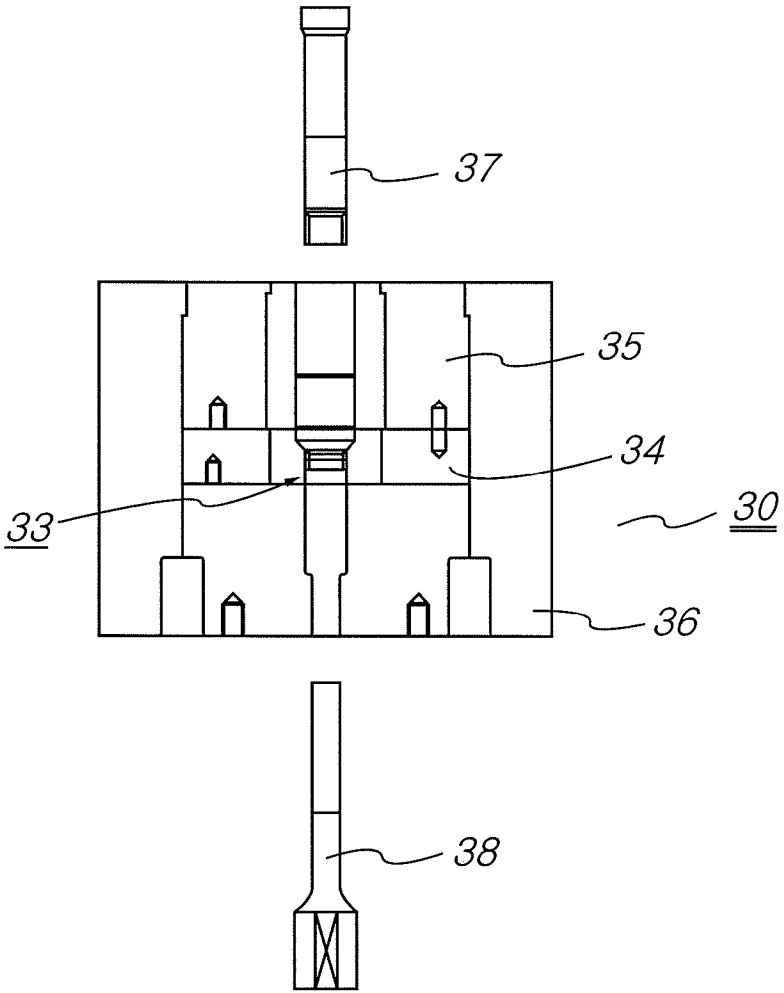
FIG. 3 is a sectional view illustrating a helical gear forging apparatus in accordance with the present invention.
Figure 4:
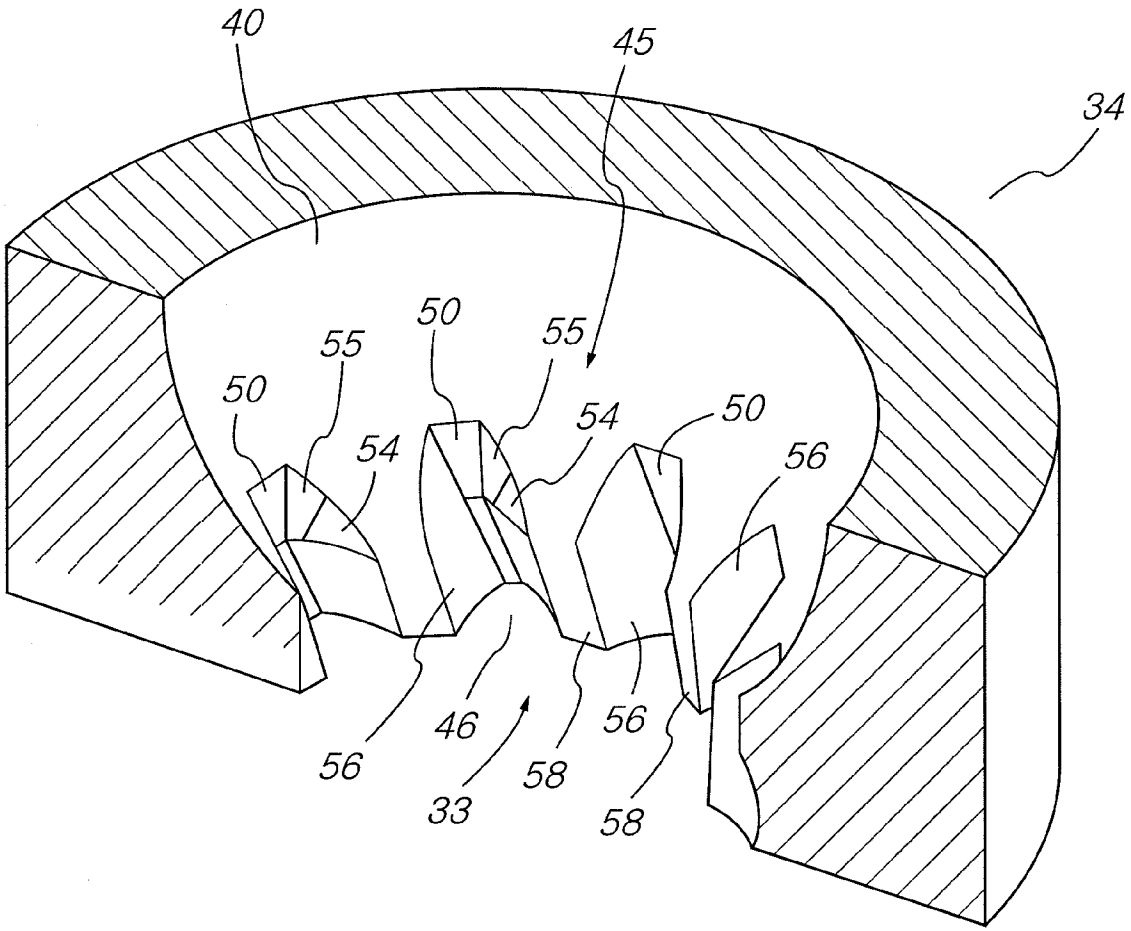
FIG. 4 is a partially broken away perspective view illustrating a gear die of the helical gear forging apparatus in accordance with the present invention.
Figure 5:
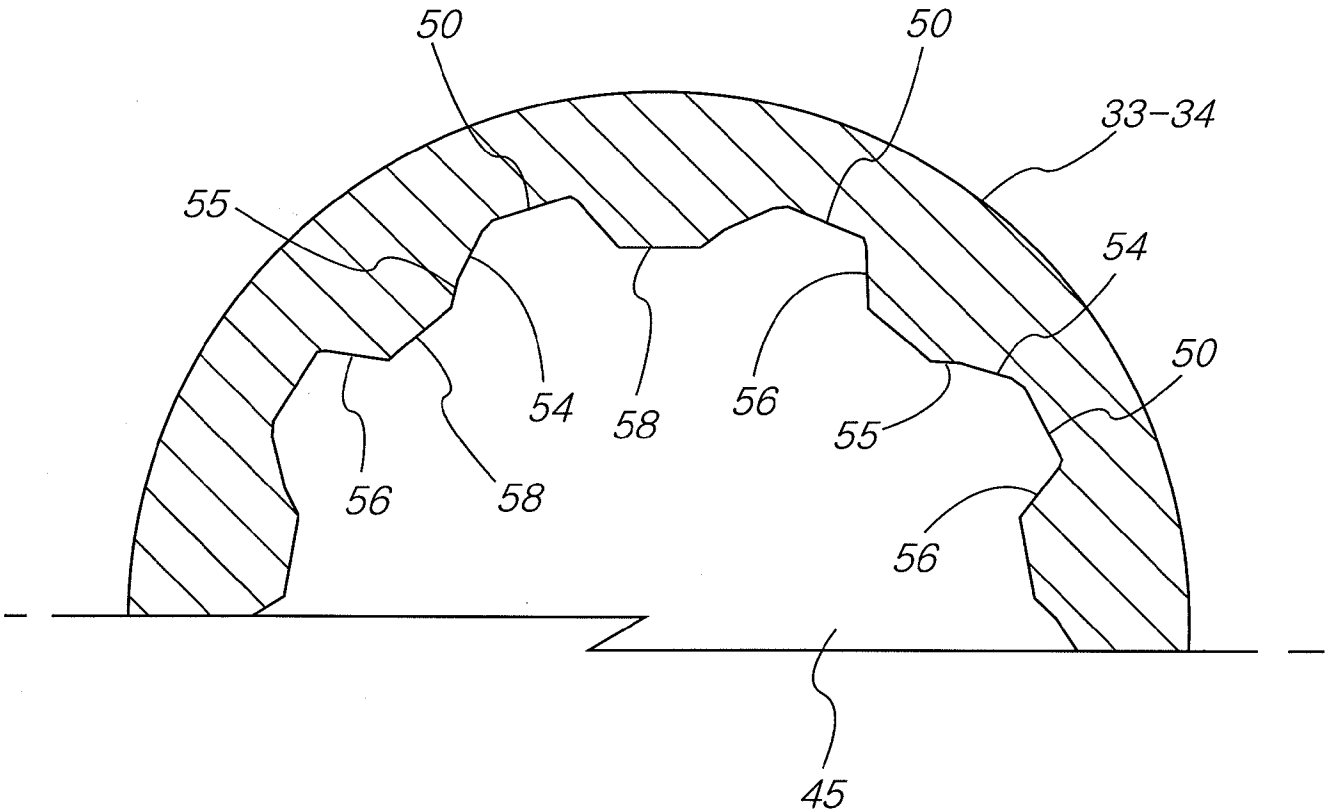
FIG. 5 is a cross sectional view illustrating a forming introduction portion of the gear die shown in FIG. 4.
Figure 6:
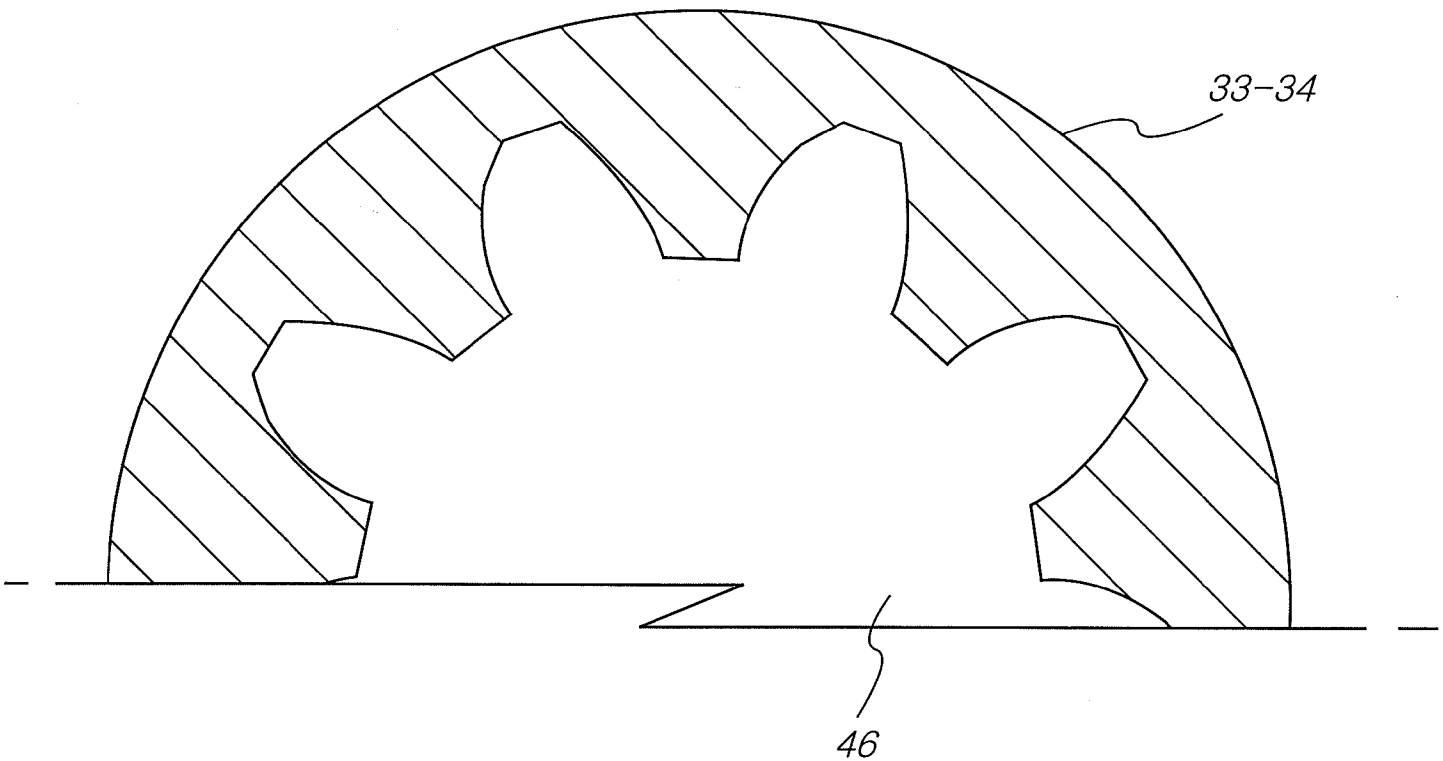
FIG. 6 is a cross sectional view illustrating a gear teeth forming portion of the gear die shown in FIG. 4.

FIG. 1 is a front view illustrating a helical gear in accordance with the present invention. FIG. 2 is an enlarged view illustrating the part of the helical gear denoted by the arrow A shown in FIG. 1. FIG. 3 is a sectional view illustrating a helical gear forging apparatus in accordance with the present invention. FIG. 4 is a partially broken away perspective view illustrating a gear die of the helical gear forging apparatus in accordance with the present invention. FIG. 5 is a cross sectional view illustrating a forming introduction portion of the gear die shown in FIG. 4. FIG. 6 is a cross sectional view illustrating a gear teeth forming portion of the gear die shown in FIG. 4.

As shown in FIGS. 1 to 6, the helical gear forging apparatus 30 according to the present invention comprises: a gear die 34 having a gear teeth forming section 33 defined at the inner circumference thereof for forming gear teeth 32 of a helical gear 31; and a collar die 35 integrally formed at an upper end of the gear die 34.

The helical gear forging apparatus 30 further comprises: a lower die 36 located below the gear die 34; a punch 37 located above the collar die 35 for pushing a stock into the collar and gear dies 35 and 34; and a knock-out 38 located below the lower die 36 for discharging the molded stock to the outside.

In the present invention, a gear teeth forming section 33 internally defined at the gear die 34 is improved in structure so as to facilitate the cold forging of the helical gear 31.

For this, the gear die 34 is improved to enable easy and accurate introduction of the stock thereinto, and to reduce axial load to be applied to the stock in the gear teeth forming section 33 of the gear die 34, thereby achieving a reduction in shear stress of the stock upon extrusion.

The gear teeth forming section 33 includes: a rounded portion 40 defined in an uppermost region of the gear die 34 to form a connection 43 of the helical gear 31; a forming introduction portion 45 located at a lower end of the rounded portion 40 and adapted to form a portion for connecting the connection 43 and the gear teeth 32 of the helical gear 31; and a main forming portion 46 connected to the forming introduction portion 45 and adapted to form the gear teeth 32 of the helical gear 31.

In the forming introduction portion 45 are patterned a plurality of connection upper-surface grooves 50. Each of the connection upper-surface grooves 50 is used to form a connection upper-surface 48 of the helical gear 31, which connects a respective one of teeth outer-diameter edges 47 of the helical gear 31 with the connection 43 formed by the rounded portion 40 in a downwardly inclined state.

At opposite sides of the connection upper-surface groove 50 are patterned a connection lower left-surface groove 54, a connection upper left-surface groove 55 and a connection right-surface groove 56. These grooves 54, 55 and 56 are used to form a connection lower left-surface 51, a connection upper left surface 52 and a connection right-surface 53, respectively. The grooves 54, 55 and 56 are connected to a root protrusion 58, which is used to form a root surface 57.

Preferably, the connection upper-surface groove 50, the connection lower left-surface groove 54, the connection upper left-surface groove 55 and the connection right-surface groove 56, which are patterned in the forming introduction portion 45, form a shape with a four-sided cross section. Such a configuration is effective to allow the stock to be taken out from the forming introduction portion 45 after being completely filled therein.

The main forming portion 46 smoothly extends from a distal end of the forming introduction portion 45 patterned with the connection upper-surface groove 50, the connection lower left-surface groove 54, the connection upper left-surface groove 55 and the connection right-surface groove 56.

With the forging apparatus of the present invention, when the stock, to be formed as the helical gear 31, is pushed into the collar die 35 and the gear die 34 by means of the punch 37, it is smoothly introduced into the gear die 34 by virtue of the rounded portion 40 defined in the uppermost region of the gear die 34 adjoining a lower end of the collar die 35.

The introduced stock is moved into the forming introduction portion 45 defined in the gear teeth forming section 33 of the gear die 34. In this case, since the connection upper-surface groove 50, the connection lower left-surface groove 54, the connection upper left-surface groove 55 and the connection right-surface groove 56, patterned in the forming introduction portion 45, form a shape with a four-sided cross section, the introduced stock can be moved into the main forming portion 46 downstream of the forming introduction portion after being completely filled in the grooves 54, 55, and 56. Thereby, the gear teeth 32 of the helical gear 31 can be formed with high accuracy.

With the forming introduction portion 45 of the gear teeth forming section 33 defined in the gear die 34 as stated above, in a state wherein the stock is completely filled in the forming introduction portion 45, the stock can be smoothly moved by virtue of the connection lower left-surface groove 54 and the connection upper left-surface groove 55 having different inclination angles adjusted on the basis of the desired helix angle, thereby enabling the stock to be formed with high accuracy. This makes it easy to form a high quality helical gear.

As apparent from the above description, according to the present invention, a forming introduction portion of a helical gear forging apparatus, used to form gear teeth of a helical gear, is variable in shape to have different inclination angles on the basis of the helix angle of the gear-teeth so as to constantly keep a predetermined outer diameter of the formed gear teeth, thereby enabling easy forming of the helical gear irrespective of a variation of the helix angle.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A forging method for forming a helical gear using a helical gear forging apparatus, the helical gear forging apparatus comprising:

a gear die having a gear teeth forming section defined at an inner circumference thereof for forming gear teeth of the helical gear;

a collar die integrally formed at an upper end of the gear die;

a lower die located below the gear die;

a punch located above the collar die and adapted to push a stock into the collar die; and a knock-out located below the lower die and adapted to discharge the molded stock to the outside, the method comprising the steps of:

a) smoothly introducing the stock into the gear die via a rounded portion defined in an uppermost region of the gear die adjoining a lower end of the collar die;

b) filling the stock in a forming introduction portion of a gear teeth forming section defined in the gear die, the forming introduction portion being patterned with a connection upper-surface groove, a connection lower left-surface groove, a connection upper left-surface groove, and a connection right-surface groove to form a shape with a four-sided cross section; and c) forming the gear teeth of the helical gear in a main forming portion downstream of the forming introduction portion with high accuracy.

2. A forging apparatus for forming a helical gear comprising:

a gear die having a gear teeth forming section defined at an inner circumference thereof for forming gear teeth of the helical gear;

a collar die integrally formed at an upper end of the gear die;

a lower die located below the gear die;

a punch located above the collar die and adapted to push a stock into the collar die; and a knock-out located below the lower die and adapted to discharge the molded stock to the outside, wherein the gear teeth forming section includes:

a rounded portion defined in an uppermost region thereof and adapted to form a connection of the helical gear, allowing the stock to be easily introduced into the gear teeth forming section;

a forming introduction portion located at a lower end of the rounded portion and adapted to form a portion of the helical gear, which connects the gear teeth and the connection of the helical gear, the forming introduction portion serving to reduce axial load to be applied to the stock and thus achieves a reduction in shear stress of the stock upon extrusion; and a main forming portion connected to the forming introduction portion and adapted to form the gear teeth of the helical gear, wherein the forming introduction portion has:

a plurality of connection upper-surface grooves, each being adapted to form a connection upper-surface of the helical gear, which connects a respective one of teeth outer-diameter edges of the helical gear with the connection formed by the rounded portion in a downwardly inclined state; and a connection lower left-surface groove, a connection upper left-surface groove and a connection right-surface groove patterned at opposite sides of the connection upper-surface groove, and adapted to form a connection lower left-surface, a connection upper left surface and a connection right-surface, respectively, the grooves being connected to a root protrusion, which is adapted to form a root surface, and wherein the main forming portion smoothly extends from a distal end of the forming introduction portion patterned with the connection upper-surface groove, the connection lower left-surface groove, the connection upper left-surface groove and the connection right-surface groove.

3. The apparatus as set forth in claim 2, wherein the connection lower left-surface groove and the connection upper left-surface groove, patterned in the forming introduction portion, have different inclination angles from each other, so as to allow the stock to be easily moved downward and be formed with high accuracy.

4. The apparatus as set forth in claim 2, wherein the connection upper-surface groove, the connection lower left-surface groove, the connection upper left-surface groove and the connection right-surface groove, which are patterned in the forming introduction portion, form a shape with a four-sided cross section, for allowing the stock to be taken out from the forming introduction portion after being completely filled therein.

* * * * *